United States Patent [19]

Hashimoto

[11] 4,242,547

[45] Dec. 30, 1980

[54] PERIODICAL SWITCHING DEVICE CAPABLE OF ADJUSTING THE OPERATION TIME

[75] Inventor: Kazuo Hashimoto, Iida, Japan

[73] Assignee: Iida Sankyo Kabushiki Kaisha, Iida, Japan

[21] Appl. No.: 930,094

[22] Filed: Aug. 1, 1978

[30] Foreign Application Priority Data

Aug. 8, 1977 [JP] Japan ..... 52-94104
Nov. 26, 1977 [JP] Japan ..... 52-141137

[51] Int. Cl.[3] ..... H01H 7/00

[52] U.S. Cl. ..... 200/38 R; 200/38 FA; 200/39 R

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 39 R; 219/10.55 R, 10.55 B

[56] References Cited

U.S. PATENT DOCUMENTS 3,922,924 12/1975 Harris ..... 200/39 R 3,995,133 11/1976 Anderson ..... 200/38 R X

*Primary Examiner*—J. V. Truhe
*Assistant Examiner*—Morris Ginsburg
*Attorney, Agent, or Firm*—James Creighton Wray

[57] ABSTRACT

A periodical switching device has adjustable periodic ON durations and has rapid on, off transitions. A swinging member rides on a rotating cam. An operation member controlled by the cam and by the swinging member turns a switch on when the cam moves the operation member and turns the switch off when the cam moves the swinging member to release the operation member. An adjusting member changes position of the swinging member to vary its point and time of initial contact with the cam to selectively control release of the operation member which turns OFF the switch. A feeding device advances the adjusting means to 100 percent conduction when the adjusting device is moved to select about 83 percent or more conduction. An old setting-clearing device moves the operation member relatively to the swinging member so that the members follow the newly set durations immediately upon beginning new cycles.

15 Claims, 42 Drawing Figures

FIG. 6
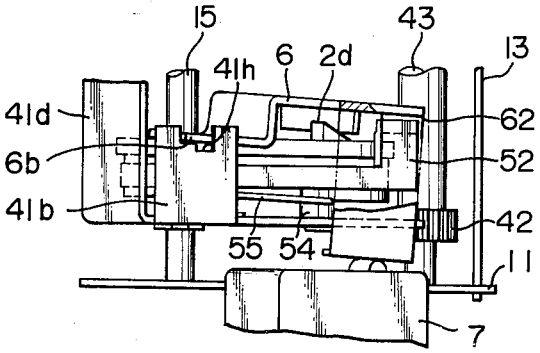
FIG. 8
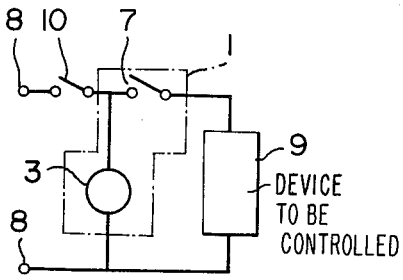
FIG. 9(a)
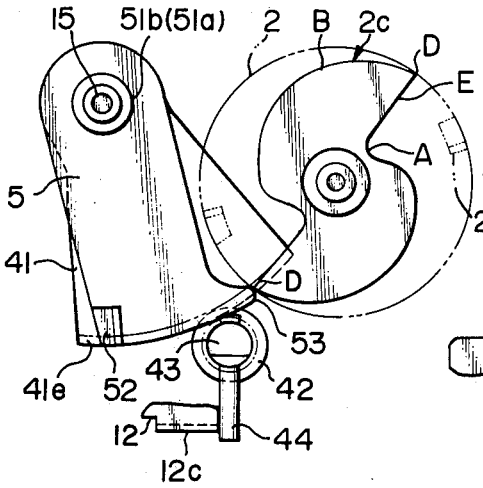
FIG.9(b)
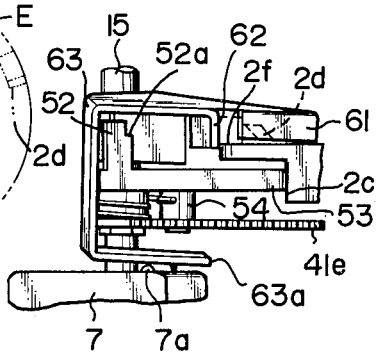
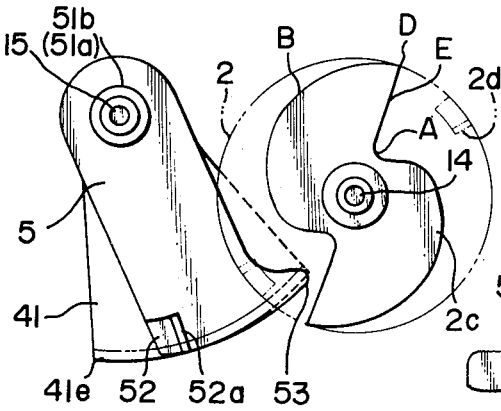
FIG. 10(a)
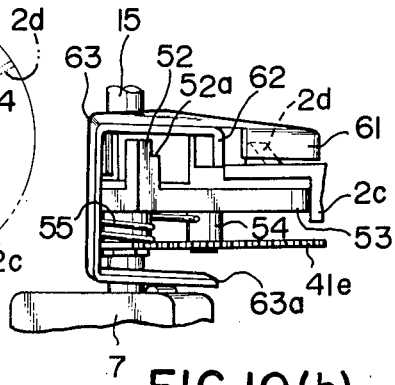
FIG. 10(b)

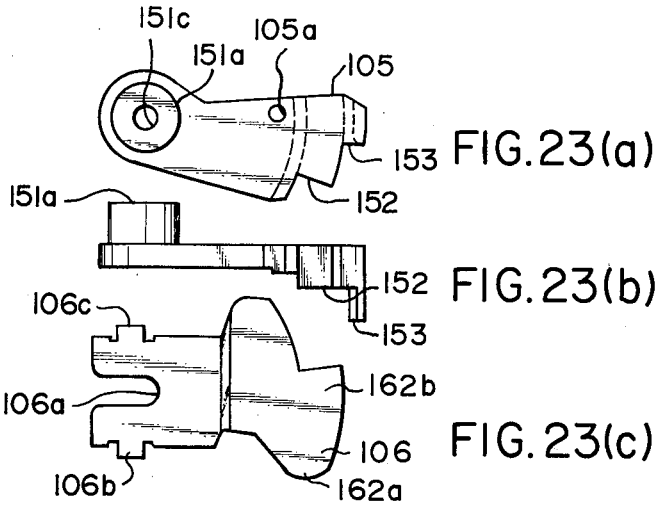
FIG. 23(a)
FIG. 23(b)
FIG. 23(c)
FIG. 24
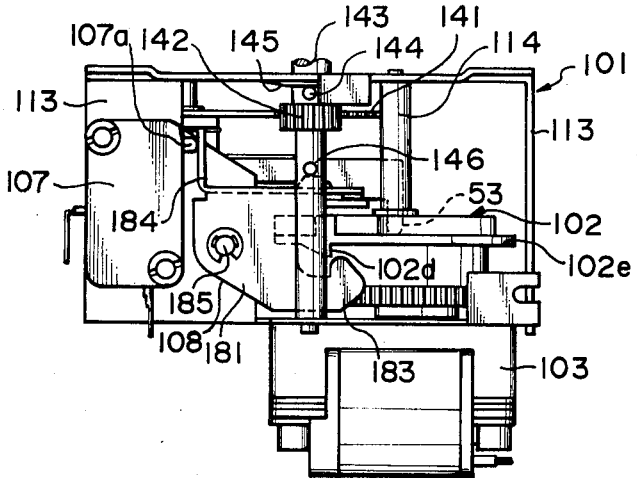
FIG. 25
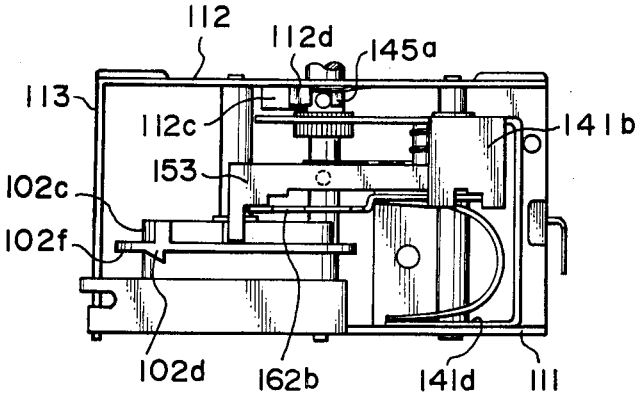

PERIODICAL SWITCHING DEVICE CAPABLE OF ADJUSTING THE OPERATION TIME

BACKGROUND OF THE INVENTION (1) Field of the Invention

The present invention is related to a periodical switching device which is optionally capable of periodically and continuously adjusting the operation time ranging from a switch closure of a short period of time through up to a continuous current-carrying state.

(2) Description of the Prior Art

Numerous kinds of electric devices have so far been developed, and many switching devices adapted to control such electric devices have been proposed depending upon the development of the electric devices. Among many electric devices, some are equipped with a switch which permits the operation time to be optionally varied at the will of a user. For example, an electronic range employing a magnetron, when used according to its purpose, features that the cooking can be carried out under quick heating at high temperatures. Depending upon the kinds of cooking, however, the quick heating at high temperatures may not be necessarily suitable. In such a case, the electronic range must have a function to reduce its output. An example which is not suitable for the quick heating at high temperatures may be the thawing cooking. A generally employed method of controlling the output of the electronic ranges consists of periodically interrupting the circuit for oscillating the magnetron to reduce the rate of oscillating time with respect to the power-producing state attained when the magnetron is continuously oscillated, within a predetermined period of cooking and heating time.

Conventional switching devices used for the aforementioned object will include, for example, a switching device shown in an expansion view of the diagram (a) of FIG. 1, in which a cam plate of which one side of a diagonal line of the rectangle is high and the other side is low, is rolled to form a cylindrical cam 2' as shown in the diagram (b), and a lever follower 5' is caused to slide in the axial directions of the cylinder 2' to utilize the change in height of the spiral cam surface; and a switching device shown in FIG. 2, in which a U-shaped yoke 12' and a lever 5' are rotatably mounted on a mounting member 11', the U-shaped yoke 12' and the lever 5' are urged toward one side by springs 18 and 19, an electric motor is mounted on the U-shaped yoke 12' so as to rotate the cam 2', and the U-shaped yoke 12' is moved together with the electric motor by means of a cam 2'' disposed on the lower side of the mounting member 11', in order that the time for opening and closing a microswitch 7 is varied by means of the lever 5'. In the former example, however, the lever follower 5= receives the forces not only in the operating direction of the switch but also in the axial direction of the cylindrical cam, whereby the operation of the lever follower becomes unreliable giving a cause of trouble. In the latter example employing a normally-closed switch, on the other hand, the contacting position of the lever 5' is gradually varied as the cam 2' rotates counter-clockwise, whereby the switch is opened and closed with slow movement. When the switch is operated with such a setup, however, the contacts are brought into contact or separated with slow motion, inviting the development of arcing across the contacts and causing the contact surfaces to be deteriorated, which is a serious defect. Furthermore, the switches incorporated in the switching devices have dispersed dynamic points which, when opened and closed at low speeds, directly reflect their dispersed quality, making it difficult to uniformalize the accuracy in control time.

SUMMARY OF THE INVENTION (1) Objects of the Invention

A primary object of the present invention, therefore, is to provide a periodical switching device which is capable of freely and continuously adjusting the operation time ranging from a brief period of switch closure time through up to a continuously current-carrying state.

Another object of the present invention is to provide a periodical switching device which is capable of adjusting the operation time exhibiting reliable and quick switch on and quick switch off performance.

A further object of the present invention is to provide a periodical switching device which is capable of adjusting the operation time, and which immediately commences the operation with a newly set state when an operation-time adjusting member is set to a new operation time.

A still further object of the present invention is to provide a periodical switching device which is capable of adjusting the operation time, which maintains a continuous current-carrying state when the new operation time is set to a current-carrying state close to the continuous current-carrying state.

(2) These and other objects, advantages, features and uses will become more apparent as the description proceeds in conjunction with the accompanying drawings in which FIG. 1-(*a*) is a front view showing a cylindrical cam used for a conventional switching device;

FIG. 1-(*b*) is a perspective view showing the operation of the cylindrical cam used for said conventional switching device;

FIG. 6 is a side view showing a major portion of the switching device of FIG. 3, which is in an OFF state;

FIG. 8 is an electric circuit diagram in which the switching device of FIG. 3 is connected to a device that is to be controlled such as an electronic range, and the like;

Figure 1:
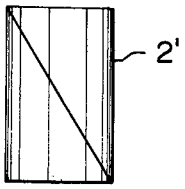
FIG. 1 (a) PRIOR ART
Figure 1:
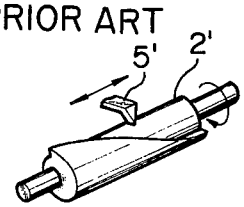
FIG. 1 (b) PRIOR ART
Figure 2:
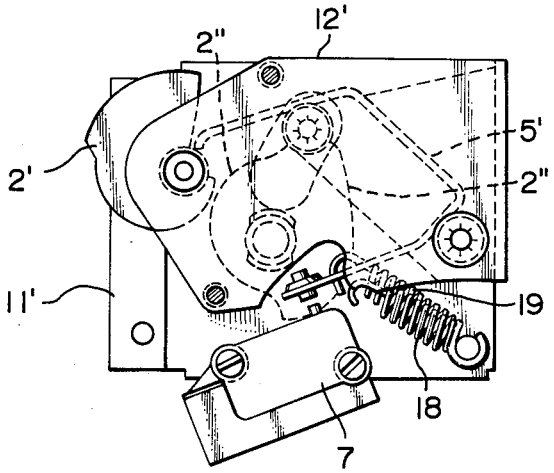
FIG. 2 (PRIOR ART)
FIG. 2 is an overall side view showing a conventional switching device.
Figure 3:
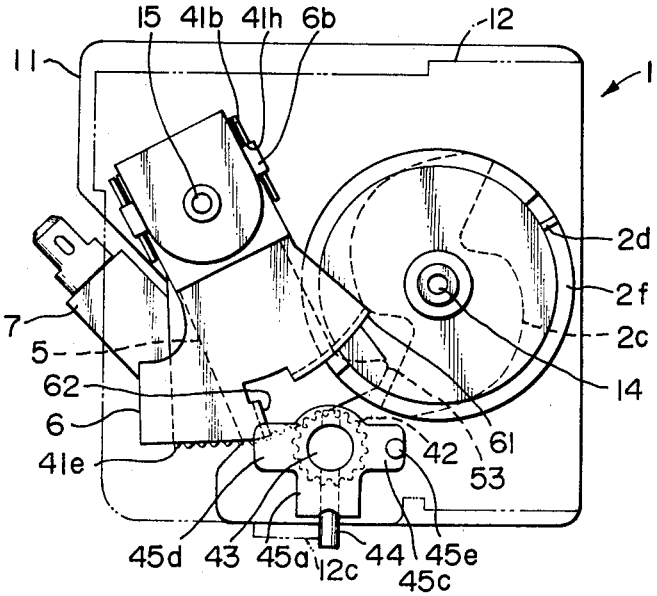
FIG. 3 is a front view showing a switching device according to a first embodiment of the present invention, in which an upper mounting member is indicated by an imaginary line.
Figure 4:
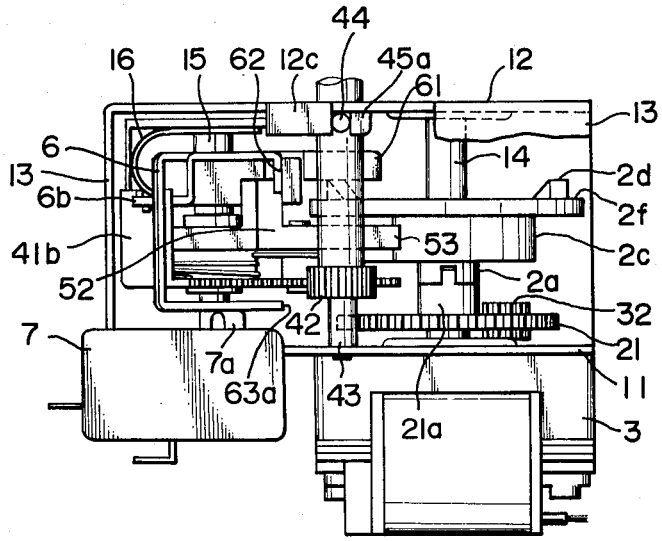
FIG. 4 is a side view showing the left side of the switching device of FIG. 3, which is in an ON state.
Figure 5:
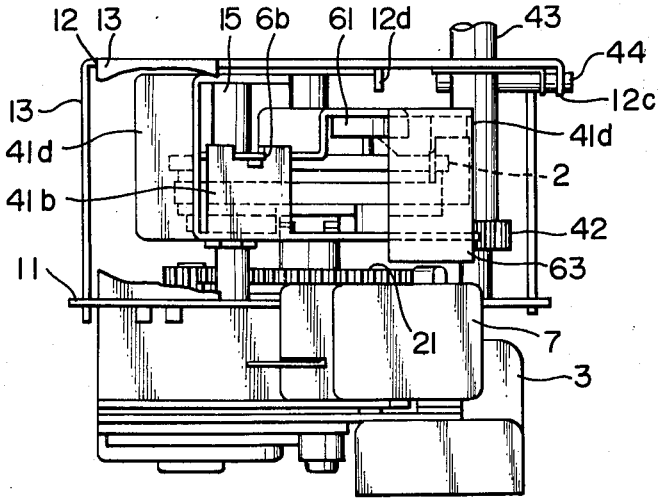
FIG. 5 is a side view showing the right side of the switching device of FIG. 3, which is in an ON state.
Figure 7:
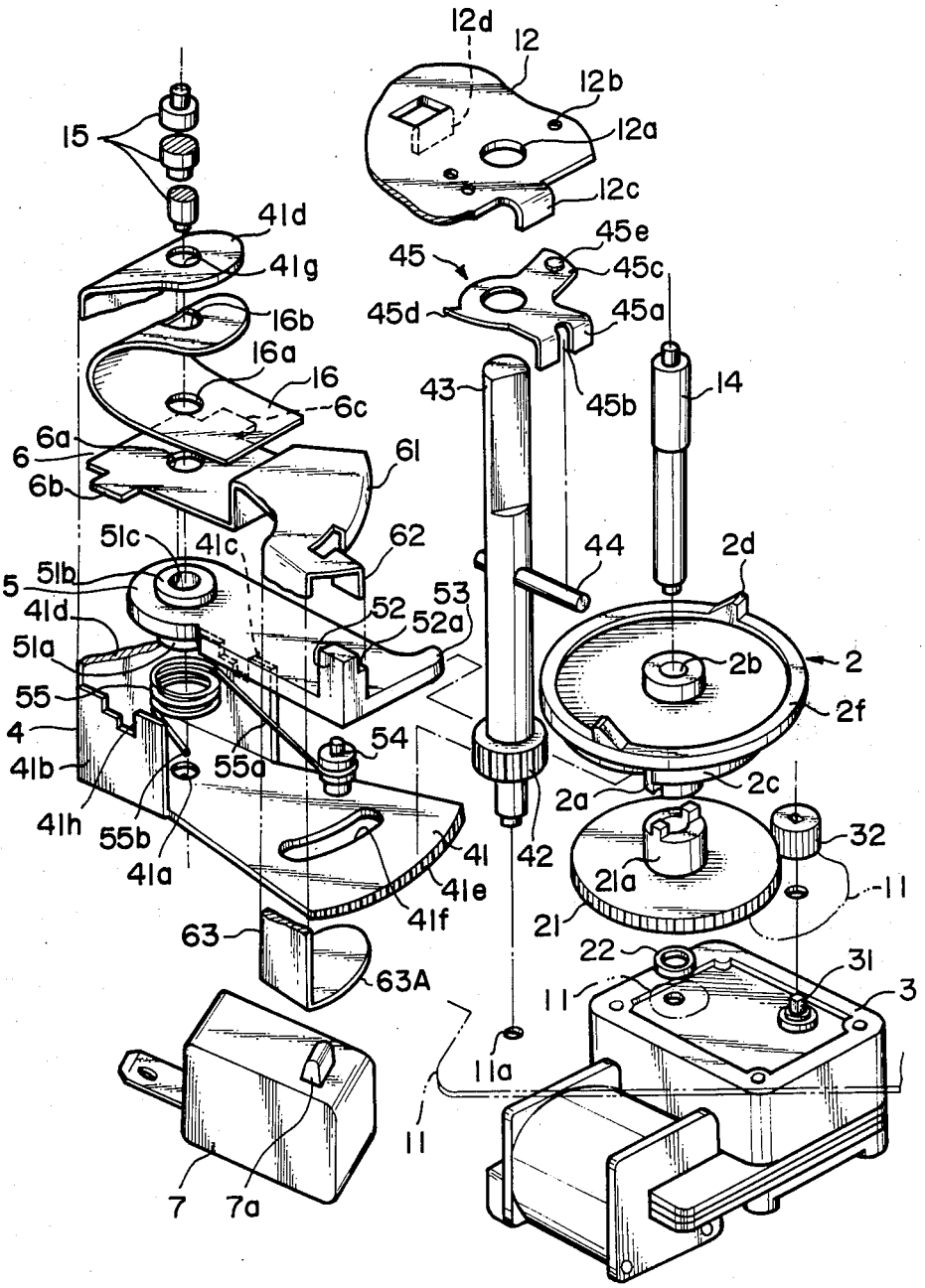
FIG. 7 is a perspective view showing the switching device of FIG. 3 in a disassembled state.
Figure 11:
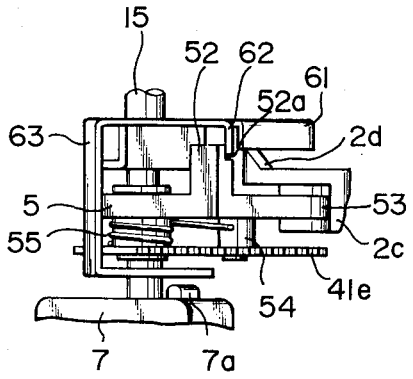
Figure 12:
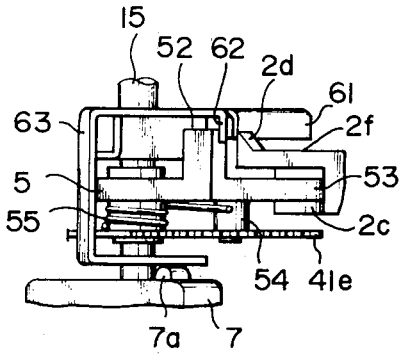
Figure 13:
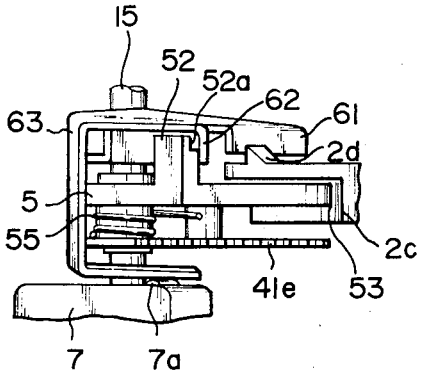
Figure 14A:
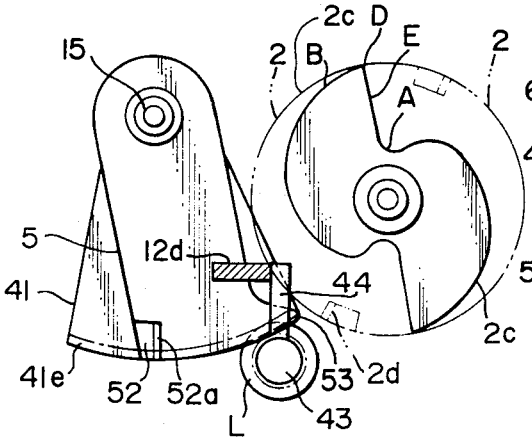
Figure 14B:
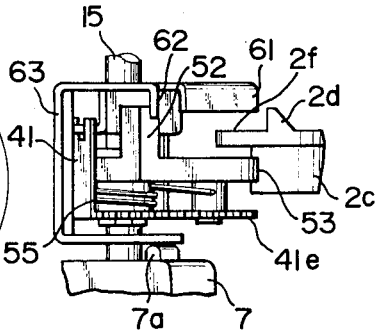
Figure 15:
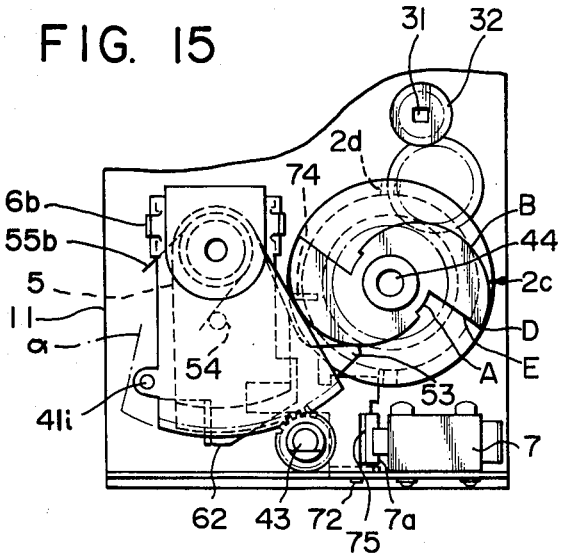
Figure 16:
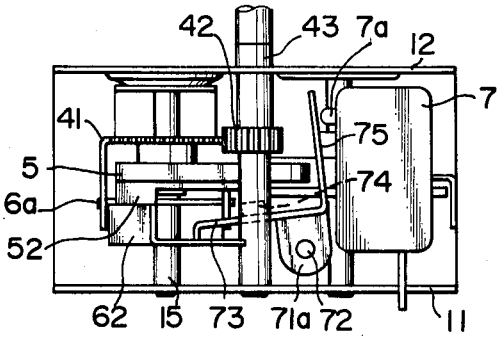
Figure 17:
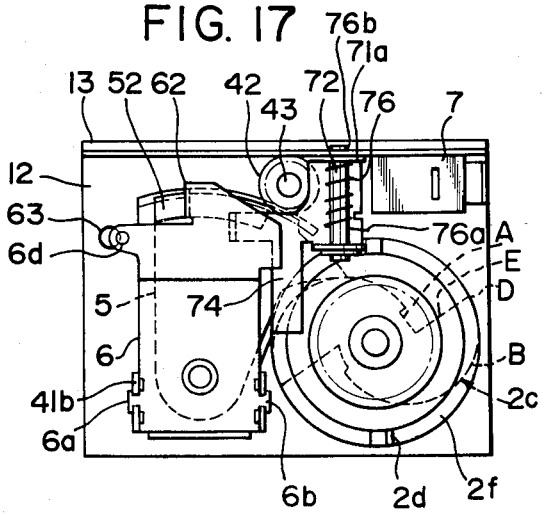
Figure 18:
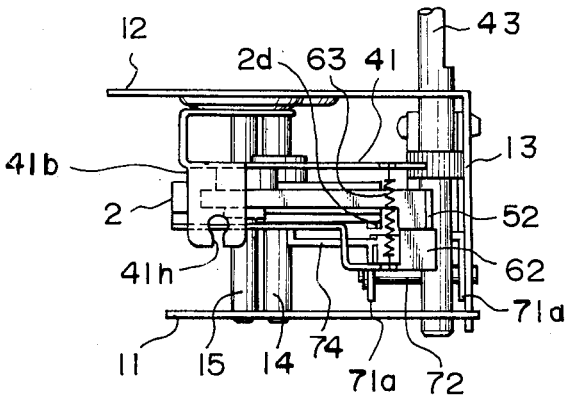
Figure 20:
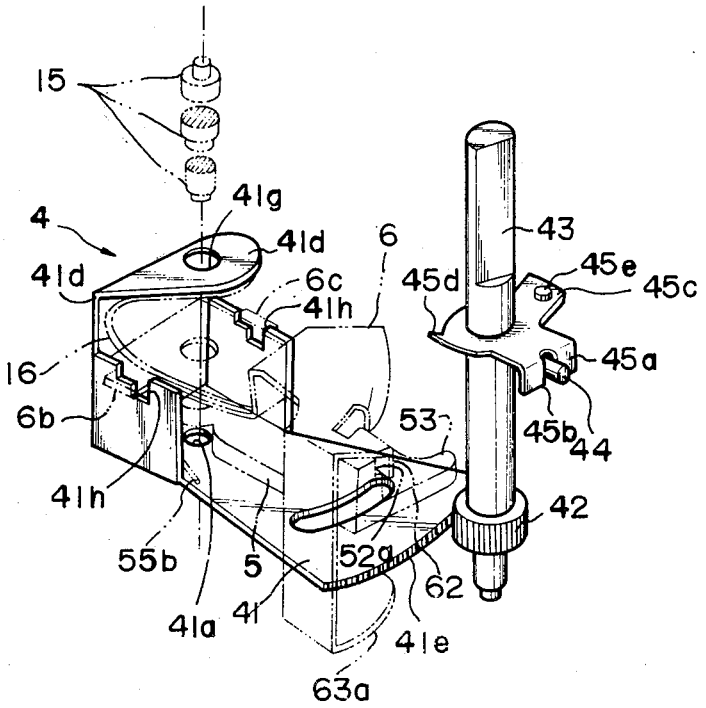
Figure 19:
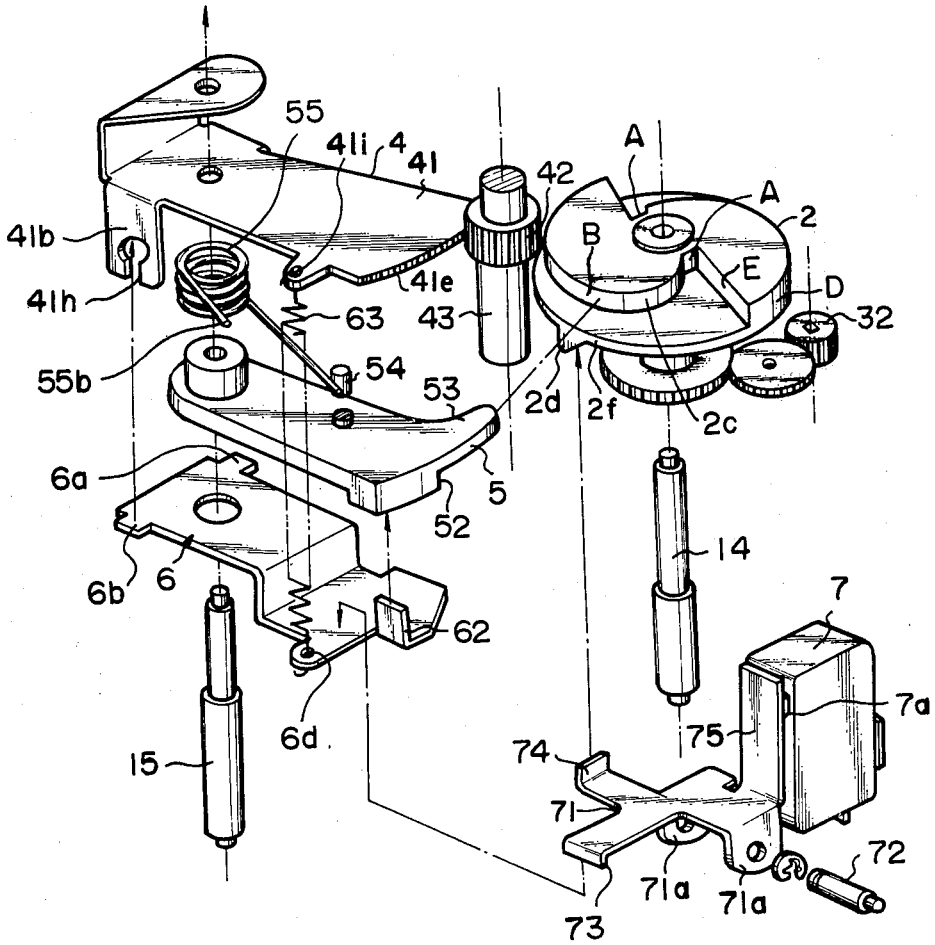
Figure 21:
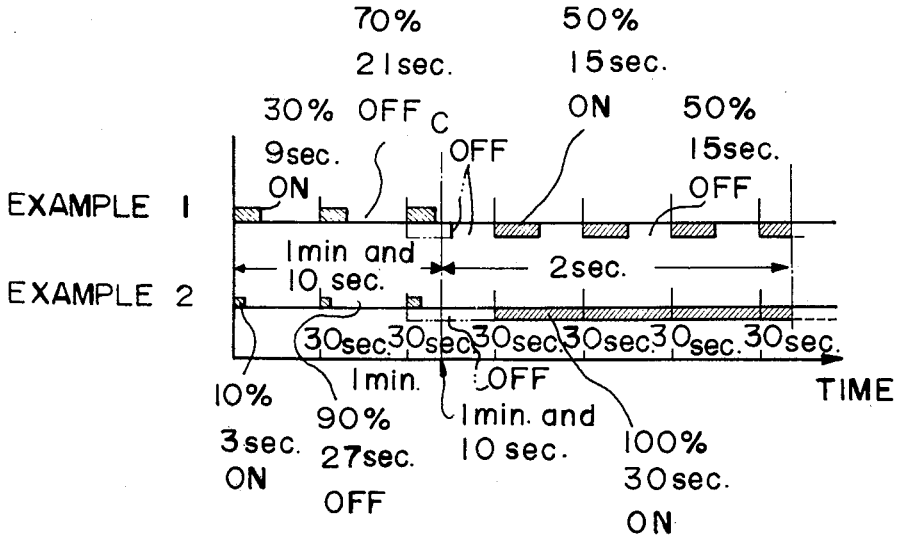
Figure 22:
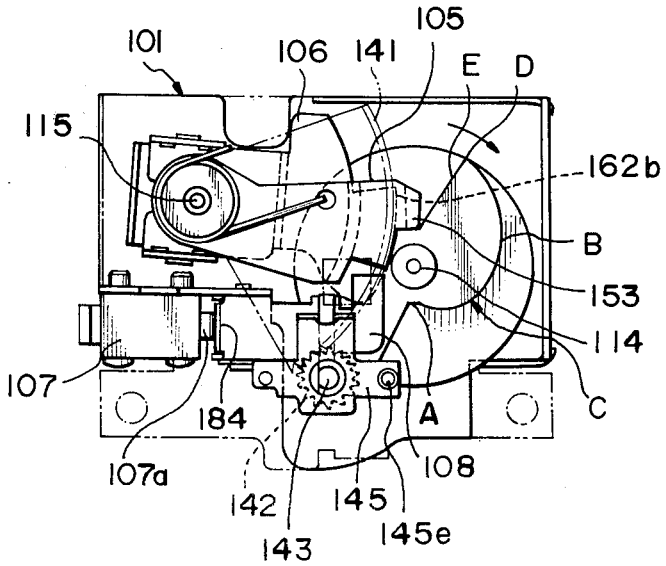
Figure 26:
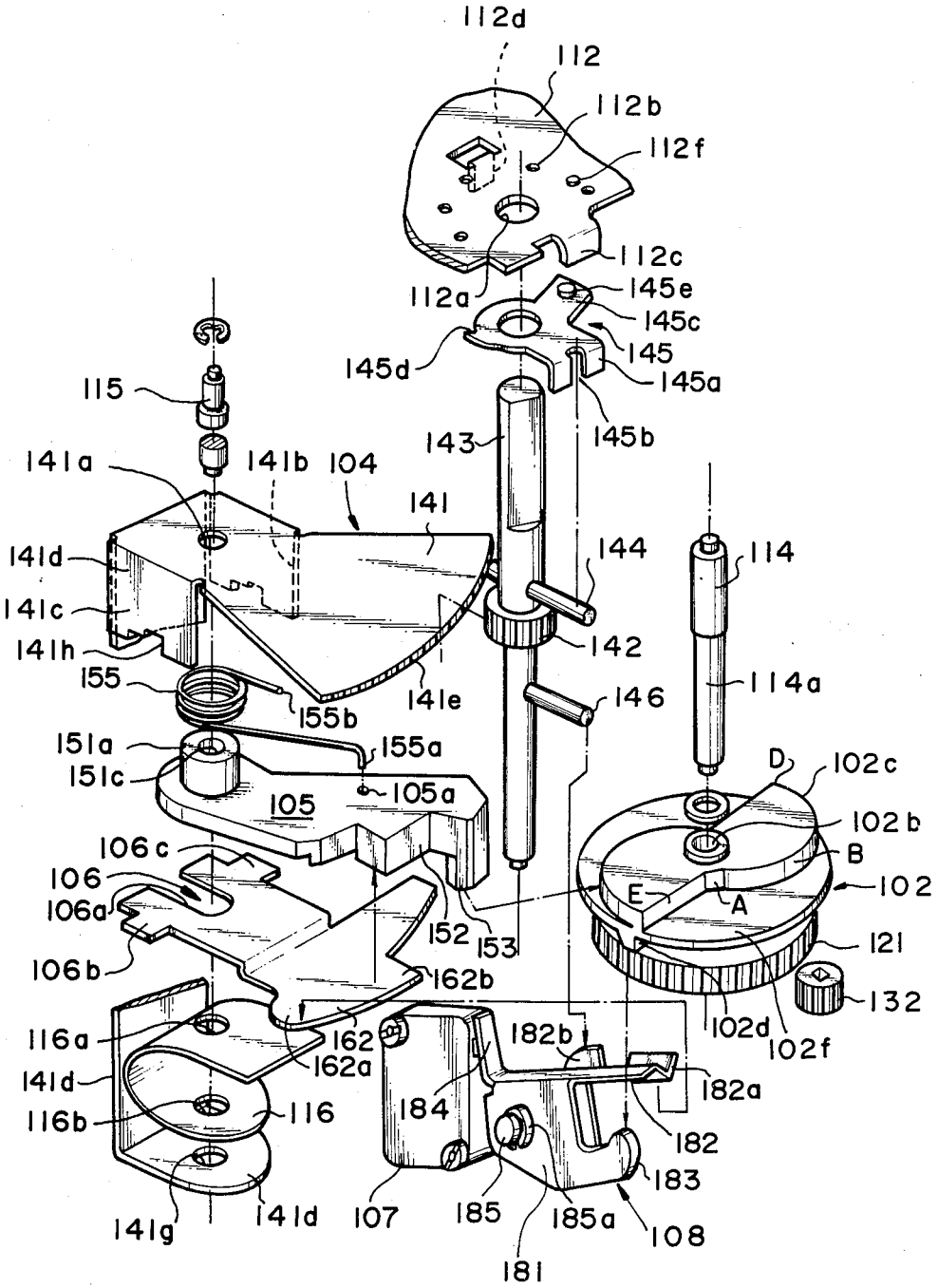
Figure 27:
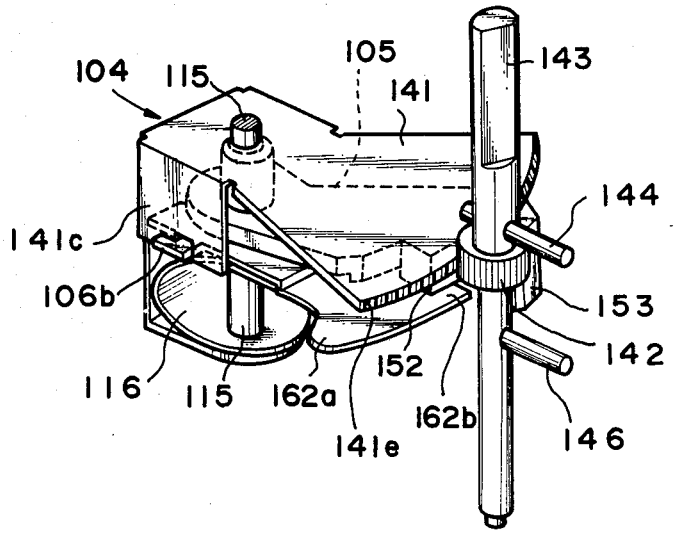
Figure 28:
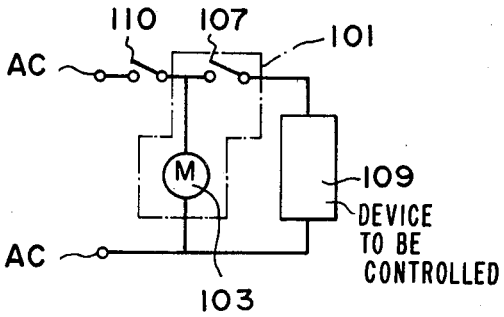
Figure 29:
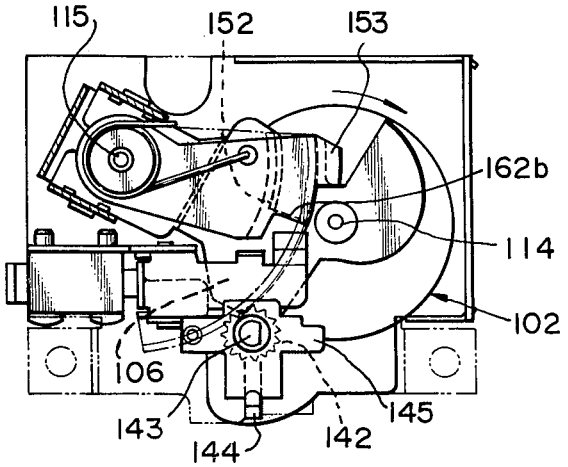
Figure 30:
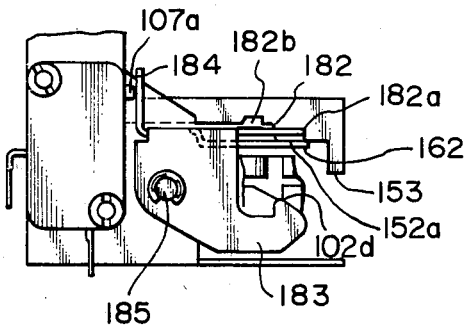
Figure 31:
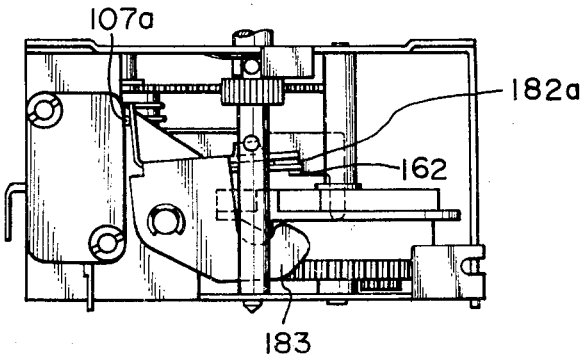
Figure 32:
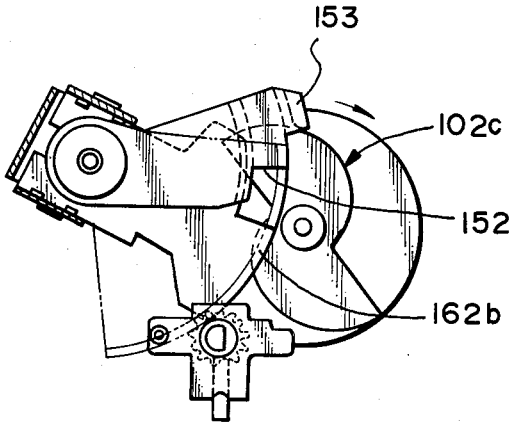
Figure 33:
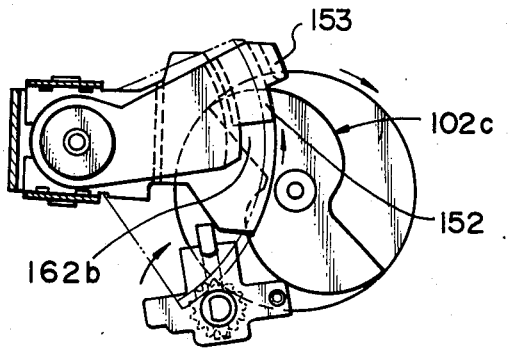
Figure 34:
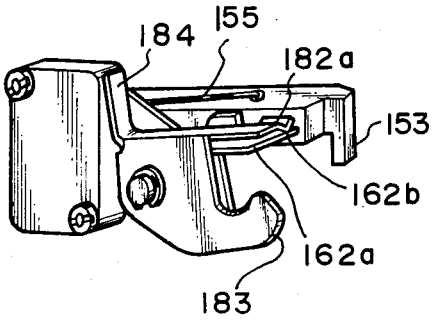
Figure 35:
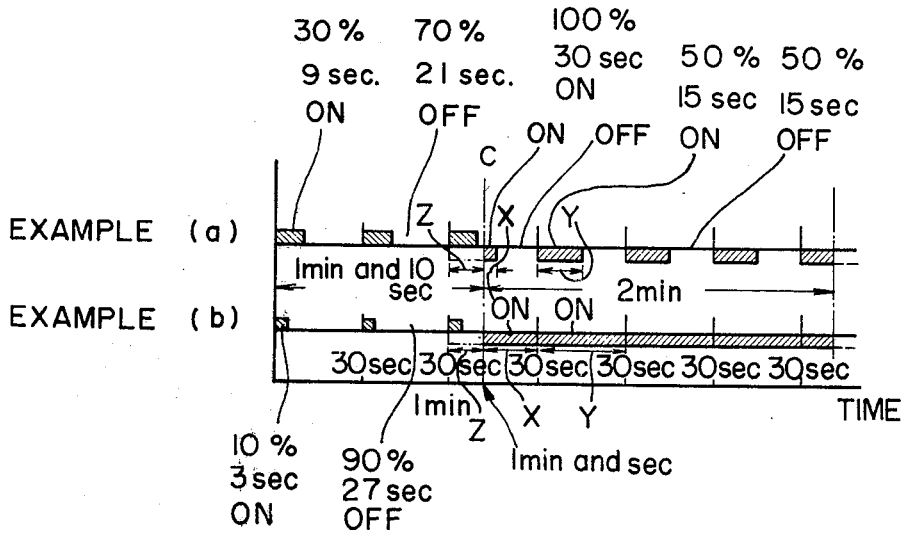
Figure 36:
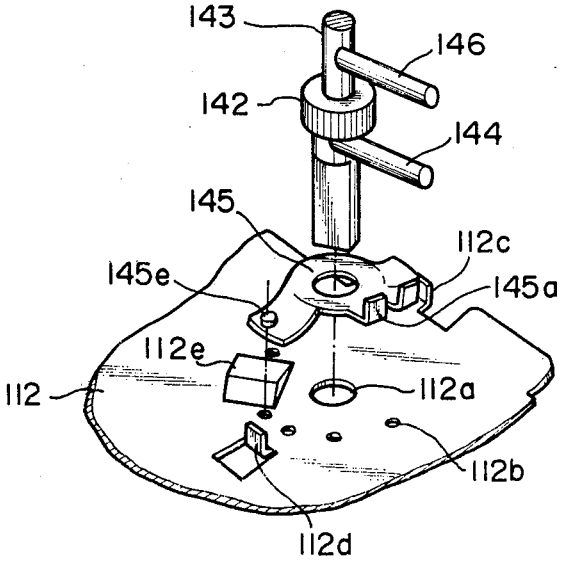

FIG. 9-(*a*) is a plan view showing an important portion, in which the set time of the switching device of FIG. 3 is adjusted to the shortest time in the ON state, whereby a swinging member is pushed toward the outermost portion;

FIG. 9-(*b*) is a side view showing an important portion of the switching device which in the same state as that of FIG. 9-(*a*);

FIG. 10-(*a*) is a plan view showing an important portion of the switching device of FIG. 3, in which the swinging member is moved toward the inner side with respect to a cam member;

FIG. 10-(*b*) is a side view showing an important portion of the switching device which is in the same state as that of FIG. 10-(*a*);

FIG. 11 is a side view showing an important portion of the switching device shown in FIG. 3, in which the swinging member is moved toward the innermost side with respect to the cam member, and a folded portion is caused to ride on a saw-tooth protrusion to engage with it;

FIG. 12 is a side view showing an important portion of the switching device of FIG. 3, in which the folded portion is caused to fall from the saw-tooth protrusion of FIG. 11 due to the turn of the cam member;

FIG. 13 is a side view showing an important portion of the switching device of FIG. 3, in which the engagement of the swinging member and the operation member which moved from the state of FIG. 12, is disengaged, so that the switching means acquires an ON state;

FIG. 14-(*a*) is a plan view showing an important portion of the switching device of FIG. 3, in which the time is set to a continuous current-carrying state which is the longest time in the ON state;

FIG. 14-(*b*) is a side view showing an important portion of the switching device in the state of FIG. 14-(*a*);

FIG. 15 is a plan view showing a switching device according to a second embodiment of the present invention, in which an upper mounting member is not shown;

FIG. 16 is a side view of FIG. 15;

FIG. 17 is a bottom view of the switching device of FIG. 15, in which a lower mounting member is not shown;

FIG. 18 is a side view showing other side of the switching device according to the second embodiment shown in FIG. 15;

FIG. 19 is a perspective view showing, in a disassembled state, the important portions of the second embodiment shown in FIG. 15;

FIG. 20 is a perspective view showing the construction of the operation-time adjusting member of FIG. 7;

FIG. 21 is a diagram of the switching device according to the first embodiment or the second embodiment of the present invention shown in FIG. 3 or FIG. 15;

FIG. 22 is a front view of a switching device according to a third embodiment of the present invention, in which an upper mounting member and a rack plate are indicated by imaginary lines, and the closure operation time of the switch is set to the continuous current-carrying state;

FIG. 23-(*a*) is a plan view of the swinging member shown in FIG. 22;

FIG. 23-(*b*) is a side view of the swinging member shown in FIG. 22;

FIG. 23-(*c*) is a plan view of the operation member shown in FIG. 22;

FIG. 24 is a side view of the third embodiment shown in FIG. 22;

FIG. 25 is a back view of the third embodiment shown in FIG. 22;

FIG. 26 is a perspective view showing, in a disassembled manner, an important portion of the third embodiment shown in FIG. 22;

FIG. 27 is a perspective view showing the operation-time adjusting member of the third embodiment shown in FIG. 22;

FIG. 28 is an electric circuit diagram in which the switching device of the third embodiment shown in FIG. 22 is connected to a device that is to be controlled such as an electronic range;

FIG. 29 is a front view showing the switching device of the third embodiment of FIG. 22, in which the switch closure operation time is set to a minimum value to render the switch ON;

FIG. 30 is a side view showing an important portion of FIG. 29;

FIG. 31 is a side view when the switching device of the third embodiment shown in FIG. 22 is rendered OFF;

FIG. 32 is a front view showing an important portion of FIG. 31;

FIG. 33 is a front view showing an important portion when the switching device of the third embodiment shown in FIG. 22 is set to a new operation time at which the switch closure time is longer than that of the state of FIG. 31;

FIG. 34 is a perspective view showing an important portion of FIG. 31;

FIG. 35 is a diagram of the switching device of the third embodiment shown in FIG. 22; and FIG. 36 is a perspective view of a means for feeding the operation-time adjusting member from a current-carrying state near the continuous current-carrying state into the continuous current-carrying state in the switching device of the third embodiment shown in FIG. 22.

DETAILED DESCRIPTION OF THE PREFERRED EMBODIMENTS

[First Embodiment]

FIG. 3 to FIG. 14 and FIG. 20 show a first embodiment according to the present invention.

As shown in FIG. 3 to FIG. 7, a switching device 1 consists of a mounting member made up of two pieces of mounting members 11 and 12, on which are mounted a cam member 2, an electric motor 3 which is a driving source, an operation-time adjusting member 4, a swinging member 5, an operation member 6, and a switching member 7. A plurality of projections 13 are formed being folded from the mounting member 12, such that the two mounting members 11 and 12 are held maintaining a predetermined distance. The projection 13 folded from the mounting member 12 may be replaced by support poles to maintain the distance. On the mounting member are mounted a cam shaft 14 and a fixed shaft 15. To the cam shaft 14 are loosely fitted the cam member 2, a gear 21 and a washer 22. The cam member 2 and the gear 21 are connected together by means of a recess and a protrusion formed on bosses 2*a* and 21*a*. The gear 21 is engaged with a pinion gear 32 attached to an output shaft 31, such that the rotational force of the electric motor 3 is transmitted thereto. The cam shaft 14 is loosely inserted in a through hole 2*b* formed at the center of said boss 2*a* of the cam member 2, a pair of cam surfaces 2*c* are formed on the lower surface of the cam member 2, and a pair of saw-tooth projections 2*d* are formed on the upper surface of the cam member 2. The shape of the cam surface 2*c* consists, as shown in FIG. 9, of a minimum-diameter portion A, a hoist portion B of which angle gradually increases with the radius of gyration of the cam member, an outer circumferential portion D and a surface E which falls from the outer circumferential portion toward the center. Here, the hoist portion B may be so formed as to increase its angle in proportion to the radius of gyration or as to increase its radius by unequal distance. To the fixed shaft 15 are loosely fitted a rack plate 41 of the operation-time adjusting member 4, the swinging member 5, the operation member 6 and a leaf spring 16. The operation-time adjusting member consists, as shown in FIG. 7 and FIG. 20, of a rack plate 41 and an operation-time adjusting shaft 43 to which is fastened a pinion gear 42. In said rack plate 41 is formed a through hole 41*a* in which will be loosely inserted said fixed shaft 15. The rack plate 41 has folded portions 41*b*, 41*c* and 41*d* at the right, left and rear positions of the through hole 41*a*, a saw tooth rack 41*e* formed at a fan-shaped free end to engage with the pinion gear 42, and a guide portion 41*f* formed of an arcuate elongated groove. The rear folded portion 41*d* is extended upward and is folded inward and has a through hole 41*g* in which said fixed shaft 15 will be inserted. In each said right and left folded portion 41*b*, 41*c* is formed a square shaft-receiving hole 41*h*. The shaft-receiving portion may be formed in a circular hole. The swinging member 5 disposed above the rack plate 41 is formed nearly in a rectangular shape, and has at its one end bosses 51*a*, 51*b* that are protruded toward the upper and lower directions and a through hole 51*c* formed at the center of the bosses. On one side at the outer end of the swinging member 5 is formed an upwardly protruding engaging portion 52 having a notched step 52*a*, and on the other side is formed a sidewardly protruding slide portion 53 which slides on said cam surface 2*c*. On the lower surface at the middle portion of the swinging member 5 is formed a projection 54 which fits to the elongated groove formed of said guide portion 41*f*. Instead of the elongated groove, the guide portion 41*f* may be formed by means of an erected piece. Around said boss 51*a* is wound a spring 55 of which one end 55*a* is hooked to the projection 54 and of which other end 55*b* is stopped by the folded portion 41*b* of the rack plate 41. Here, the projection 54 to which is hooked one end 55*a* of the spring 55 is pressed onto one side of the elongated groove of the guide portion 41*f*. Being urged by said spring 55, the slide portion 53 of the swinging member 5 is pressed onto the cam surface 2*c*. The aforesaid spring connection may also be constituted by forming a through hole in the rack plate 41 such that the other end 55*b* of the spring 55 is hooked thereto. The operation member 6 is disposed above said swinging member 5. The operation member 6 has at its one end a through hole 6*a* in which will be loosely inserted said fixed shaft 15. Projections 6*b*, 6*c* formed on both sides of the through hole 6*a* are engaged with the shaft-receiving portions 41*h* formed in the folded portions 41*b*, 41*c* of the rack plate 41, whereby the operation member 6 is so pivoted that a free end thereof can be moved in the upper and lower directions. The operation member 6 has at its free end a downwardly folded portion 61, an engaging portion 62, and a folded tongue piece 63 which is further folded at the tip of the downwardly extended tongue piece. Said folded portion 61 is so disposed that when it rides on a saw-tooth projection 2*d* of the cam member 2, the operation member 6 is upwardly turned with said projections 6*b*, 6*c* as a center. Said engaging portion 62 is so formed as to ride on a notched step 52*a* formed at the tip of the engaging portion 52 of the swinging member 5. The folded tongue piece 63 is folded at the lower side of the lower rack plate 41, and beneath the inward folded tongue portion 63*a* is positioned a contactor 7*a* of a switch member 7. Above said operation member 6 is provided a leaf spring 16 having two relatively large through holes 16*a*, 16*b* in which will be inserted said fixed shaft 15. The leaf spring 16 is curved in a U-shape, and is inserted between said operation member 6 and the folded portion 41*d* of the rack plate 41 such that the operation member 6 and the swinging member 5 are pressed onto the rack plate 41. Said operation-time adjusting shaft 43 is rotatably inserted in through holes 11*a*, 12*a* formed in the mounting members 11 and 12. To the lower side of the operation-time adjusting shaft 43 is attached the pinion gear 42, and at the middle portion of the operation-time adjusting shaft 43 is secured a pin 44. When the operation-time adjusting shaft 43 is mounted on the mounting member, a click-stop leaf spring 45 is inserted between the pin 44 and the mounting member 12. The click-stop leaf spring 45 is formed in a three-forked shape, one leg 45*a* of which being folded downwardly and having a groove 45*b* in which will be inserted said pin 44. The other two legs 45*c* and 45*d* are slightly curved upwardly to downwardly urge the operation-time adjusting shaft 43. An upwardly directed projection 45*e* is formed on both or either one of said two legs 45*c* and 45*d*, so that the leaf spring 45 is clicked and stopped when the projection 45*e* is inserted in a through hole 12*b* formed in the mounting member 12. On the mounting member 12 are formed a folded portion 12*c* folded at the edge, and a folded portion 12*d* erected from the mounting member 12 at nearly equal distances from said through hole 12*a*. Said two folded portions 12*c* and 12*d* come into contact with the pin 44 when said operation-time adjusting shaft 43 is turned to stop it. The switch member 7 consists of a microswitch fastened to a folded portion of the mounting member 11 by means of screws. The switching member may of course be constituted using other switches. Here, however, a normally-closed switch is employed.

The thus constructed switching device 1 permits the circuit of the switch member 7 to be connected in series between a power supply 8 and a device 9 to be controlled such as an electronic range as shown in FIG. 8, whereby an electric motor 3 is connected in series with the power supply 8. A main switch 10 may further be connected to said electric circuit. If the main switch 10 is turned on, the electric motor 3 is rotated causing the cam member 2 to turn counterclockwise in FIG. 7 and 9-(*a*). The operation-time adjusting shaft 43 is then turned clockwise until the pin 44 comes into contact with the folded portion 12*c* of the mounting member 12 as shown in FIG. 9-(*a*). At this position, the switch member 7 exhibits the shortest period of switch-on operation time. In FIG. 9-(*a*), the slide portion 53 of the swinging member 5 is in contact with the outer circumferential portion D being urged by a spring 55 (shown in FIG. 7). In this state, the engaging portion 52 of the swinging member 5 is pushed out leftwardly as shown in FIG. 9-(*b*). The folded portion 61 of the operation member 6 is disengaged from the saw-tooth projection 2*d* of the cam member 2 to ride on the upper surface 2*f* of the cam member 2, and the engaging portion 62 is disengaged from the engaging portion 52. The operation member 6 therefore is downwardly pushed by the leaf spring 16, and the tongue portion 63*a* of the folded tongue piece 63 depresses the contactor 7*a* of the switch member 7; the switch of the switch member 7 is rendered OFF.

Next, as the cam member 2 is rotated and the slide portion 53 is disengaged from the outer circumferential portion D of the cam surface 2c, the slide portion 53 moves along the falling surface E of the cam surface 2c, the swinging member 5 moves toward the right, i.e., turns counterclockwise in the drawing, thereby to assume a state shown in FIG. 10. In this state, the folded portion 61 rides on the upper surface 2f of the cam member 2, and the engaging portion 52 is not positioned below the engaging portion 62. The operation member 6 therefore is tilted down, and the switch member 7 maintains an OFF state.

As the cam member 2 is further rotated, the saw-tooth projection 2d enters beneath the folded portion 61 to push it up. Operation member 6, tongue piece 63 and tongue portion 63a are lifted upward, thereby allowing contactor 7a to return upward, turning switch 7 ON. Further, there is no obstacle except the minimum-diametered portion A of the cam surface 2c in the proceeding direction of the slide portion 53. Accordingly, the swinging member 5 is further turned toward the right, and the engaging portion 52 of the swinging member 5 moves toward the lower side of the engaging portion 62 of the operation member 6 which is pushed upwardly as shown in FIG. 11, causing the switch of the switch member 7 to be held ON.

As the cam member 2 further rotates beyond the above state, the folded portion 61 riding on the saw-tooth projection 2d falls, whereby the engaging portion 62 rides on the notched step 52a so that the switch maintains the ON state.

As the cam member 2 is further turned, the slide portion 53 comes into contact with the hoist portion B which gradually increases with respect to the rotating diameter of the cam surface 2c. The swinging member 5 is turned toward the left in the drawing, i.e., turned clockwise. As the engaging portion 52 moves by the width of the notched stop 52a, the engaging portion 62 falls from the notched step 52a as shown in FIG. 13, whereby the operation member 6 is pushed downwardly, the tongue portion 63a depresses the contactor 7a of the switch member 7, and the switch of the switch member 7 is quickly converted into OFF. Thereafter, the swinging member 5 is pushed toward the left due to the inclination of the hoist portion B following the turn of the cam member 2, and restores to the position of FIG. 9. The same operation is then repeated.

The operation-time adjusting shaft 43 is then turned in the counterclockwise direction FIG. 14 until the pin 44 comes into contact with the folded portion 12d (FIG. 7). Then, as shown in FIG. 14, the slide portion 53 of the swinging member 5 moves to a position separated away from the cam surface 2c of the cam member 2; the swinging member 5 does not receive the effect of the cam and does not undergo the swinging motion. The engaging portion 62 of the operation member 6, on the other hand, rides on the notched step 52a of the engaging portion 52 of the swinging member 5 and maintains this riding state since the swinging member 5 does not swing. The folded portion 61 of the operation member 6, on the other hand, is moved in the upper and lower directions due to the saw-tooth projections 2d of the cam member 2. However, since the engaging portion 62 is riding on the notched step 52a of the engaging portion 52, the operation member does not become lower than the height of the notched step 52a. The tongue portion 63a of the folded tongue portion 63 does not depress the contactor 7a of the switch member 7; the switch of the switch member 7 maintains the ON state. Therefore, the arrangement shown in FIG. 14 constitutes a continuous current-carrying state.

To select the rotating angle of the operation-time adjusting shaft 43 over a range from the position of the shortest period of time at which the pin 44 comes into contact with the folded portion 12c as shown in FIG. 9 through up to the position of the continuous current-carrying state at which the pin 44 comes into contact with the folded portion 12d as shown in FIG. 14, the swinging member 5 is determined for its position relative to the cam surface 2c of the cam member 2 depending upon the rotating angle of the operation-time adjusting shaft 43. As a result, the amplitude of the swinging motion is varied by varying with respect to cam 2 the angular position of adjusting member 4 and interconnected swinging member 5 and operating member 6. Swinging member 5 begins contact the hoist portion B of cam surface 2c, and as the swinging member 5 is pushed by hoist portion B of the cam surface 2c against the force of the spring 55. The engaging portion 52 moves out of contact with engaging portion 62. Operation member 6 is forced downward by spring 16, depressing contactor 7a and turning switch 7 OFF. Turning adjusting shaft 43 adjusts the cyclic portion where swinging member 5 first contacts cam surface 2c, whereby the period of operation time, i.e., the period of closing of the switch member is arbitrarily determined depending upon the time required for swinging and the time required for engaging and disengaging the engaging portions of the operation member 6 and the swinging member 5. Contactor 7a remains up and switch 7 remains closed and ON until swinging member 5 releases operation member 6 to spring downward. Cam surface 2d lifts member 6 resetting the switch to ON. The dial graduations for indicating the turn of the operation-time adjusting shaft may be selected depending upon the rate of increase with respect to the angle of gyration of the hoist portion of the cam surface. In the case of the proportional variation, the dial should be equally graduated. In the case of unequal variation, the short time intervals should be broadly graduated by the dial and the long time intervals should be narrowly graduated with reference to the shape of the cam surface.

[Second Embodiment]

FIG. 15 to FIG. 19 show a second embodiment according to the present invention.

In the second embodiment of the invention, the upper and lower mounting members 11, 12 are supported maintaining a predetermined distance by means of a plate-like erected portion 13, and on plates 11 and 12 are mounted a cam shaft 14 and the fixed shaft 15 in the same manner as the aforementioned first embodiment. To the cam shaft 14 is loosely fitted the cam member 2 which is turned by an electric motor which serves as a drive source. (not shown). In this embodiment, contrary to the aforementioned embodiment, the cam surface 2c is formed on the upper side of the cam member 2, and the saw-tooth projections 2d are formed on the lower side of the cam member 2. To the fixed shaft 15 are loosely fitted the operation-time adjusting member 4, the swinging member 5 and the operation member 6, all upside down so that they are adapted to the cam member 2. The swinging member 5 is formed nearly in a rectangular shape and has near one end a through hole in which will be loosely inserted the fixed shaft 15, and further has an engaging portion 52 on the lower surface at one side near the free end thereof. From the other side at the free end is protruded a slide portion 53 which comes into contact with the cam surface 2*c* of the cam member 2. Projections 6*c*, 6*b* formed in said operation member 6 are rotatably pivoted by the shaft-receiving portions 41*h* formed in legs 41*b* in the rack plate 41 of the operation-time adjusting member 4. A spring 63 is loaded between the rack plate 41 of the operation-time adjusting member 4 and the operation member 6, such that the free ends of the two members approach each other. An expanding spring should be used when it is to be hooked at the rear side of the fixed shaft 15, and a contracting spring should be used when it is to be hooked to the through holes 41*i* and 6*d* on the side of the free end. In the operation member 6 is formed an upwardly folded engaging portion 62 which will ride on the engaging portion 52 of the swinging member 5. The switch of the switch member 7 is opened and closed by means of a switch-operating member 71 which is actuated by the operation member 6. The switch-operating member 71 is attached to the mounting member by means of a shaft 72, which is cantilevered to the plate-like erected portion 13, and is allowed to rotate about the shaft 72. The switch-operating member 71 consists of a pair of shaft-receiving portions 71*a* for pivotally supporting said shaft 72, a first tongue portion 73 extending toward the direction of said operation member 6 and downwardly folded at its tip, a second tongue portion 74 extending in a direction at right angles to the first tongue portion 73 but on a same plane, said second tongue portion 74 being adapted to ride on the saw-tooth projection 2*d* of said cam member 2, and a third tongue portion 75 which is vertically erected near a shaft-receiving plate 71*a*. To the third tongue portion 75 is faced the contactor 7*a* of the switch member 7 attached to the erected portion 13. A spring 76 (FIG. 17) is wound on said shaft 72, one end 76*a* of the spring being hooked to the switch-operating member 71, and the other end 76*b* of the spring being hooked to the erected portion 13 or the mounting member 11, such that the first tongue portion 73 is faced above the operation member 6, and the second tongue portion 74 is pressed onto the saw-tooth projection 2*d* formed on the lower surface of the cam member 2 or onto the lower surface 2*f* of the cam member 2. A pinion gear 42, which meshes with a saw tooth 41*e* formed on the rack plate 41 of the operation-time adjusting member 4, is fastened to the operation-time adjusting shaft 43 which is rotatably supported by the mounting members 11 and 12. The turn of the operation-time adjusting shaft 43 is restricted by a click-stop member and a contacting member which are not shown but which may be similar to those shown in the first embodiment In the case of this second embodiment also, the operation-time adjusting shaft 43 is turned to set the position of the rack plate 41, thereby to adjust the position of the swinging member 5 relative to the cam surface 2*c* of the cam member 2. Referring to FIG. 15 to FIG. 18, the operation-time adjusting member is set at a position of a given period of operation-time, and the swinging member 5 is positioned at the innermost position. Under this state, the engaging portion 62 of the operation member 6 rides on the engaging portion 52 of the swinging member 5, whereby the first tongue portion 73 of the switch-operating member 71 rides on the operation member 6 and is turned counterclockwise (FIG. 16) with the shaft 72 as a center being urged by the spring 76, the third tongue portion 75 is placed away from the contactor 7*a* of the switch member 7, and the switch of the switch member 7 employing a normally-closed switch is rendered ON. The second tongue piece 74 of the switch-operating member 71 has now been recovered from the state in which it was once pushed down by the saw-tooth projection 2*d* of the cam member 2.

Next, as the cam member 2 is turned, the slide portion 53 of the swinging member 5 is pushed toward the left in the drawing, i.e., turned clockwise due to the hoist portion B on the cam surface 2*c* overcoming the force of the spring 55, and the engaging portion 52 is disengaged from the engaging portion 62. As the engaging portion 52 disengages from the engaging portion 62, the operation member 6 is lifted up by the spring 63, causing the first tongue portion 73 of the switch-operating member 71 to follow, whereby the switch-operating member 71 turns clockwise with the shaft 72 as a center, and the third tongue portion 75 depresses the contactor 7*a* of the switch member 7 to render the switch turned OFF. The folded portion of the second tongue portion 74 is in contact with the lower surface 2*f* of the cam member 2.

As the cam member 2 is further turned and the slide portion 53 comes into contact with the outer circumferential portion D of the cam surface 2*c*, the swinging member 5 is pushed out to its maximum of amplitude.

As the cam member 2 is further rotated, the slide portion 53 falls from the outer circumferential portion D onto the minimum-diametered portion A sliding along the falling surface.

When the cam member 2 is turned further, the second tongue portion 74 is pushed down by the saw-tooth projection 2*d*, the engaging portion 62 is positioned below the engaging portion 52, and the switch of the switch member 7 is rendered to turn ON. A further turn of the cam member 2 enables the device to return to the initial state shown in FIG. 15; one cycle of switching operation is completed, and the same switching operation is repeated thereafter.

To lengthen the conductive state of the switching device in one cycle, the operation-time adjusting shaft 43 is turned counterclockwise in FIG. 15 like the aforementioned first embodiment, and the rack plate 41 is moved to the position indicated by an imaginary line $\alpha$ in FIG. 15 which is a maximum position. The slide portion 53 of the swinging member 5 is disengaged from the cam surface, the engaging portion 62 is positioned beneath the engaging portion 52, and the operation member 6 performs the movement of a short stroke in the upper and lower directions being driven by the saw-tooth projection 2*d* via the switch-operating member 71. In this case, the swinging member 5 does not swing, and the switch of the switch member 7 maintains an ON state which is a continuous current-carrying state.

The operation time can be arbitrarily adjusted over a range of from said short period of time through up to the continuous current-carrying state by means of said operation-time adjusting shaft 43.

In the foregoing description, the switch member was opened and closed by providing the rack plate of the operation-time adjusting member and the operation member on the upper and lower sides of the swinging member. It should, however, be noted that the switching operation can be effected by any other modified methods, for example, by providing a rack plate which can move in the upper and lower directions, permitting an engaging portion provided on the swinging member to ride on the engaging portion provided on the rack plate, such that the rack plate works as an operation member. Furthermore, the switch-operating member of the second embodiment may be employed for the first embodiment in which the swinging member and the operation member are pivotally supported by a common shaft above the rack plate.

If a normally-open switch is used as a switch of the switch member 7, the ON state of a short period of time is converted into the ON state of a long period of time, and the continuous current-carrying state is converted into the OFF state.

In the foregoing description, the switching device was illustrated with reference to the electric motor as a source of drive, but it should be understood that a clockwork using a spring motor may also be employed.

Moreover, in the aforementioned second embodiment, the spring for urging the switch-operating member in one direction, can be substituted by utilizing the resiliency of the tongue portion of the switch-operating member and the resiliency of the switch.

According to the first embodiment and second embodiment of the present invention constructed as mentioned in the foregoing, the period of opening and closing the switching device can be arbitrarily set from a short period of operation time through up to a long period of operation time, i.e., to a continuous current-carrying state. Further, the gear ratio of the saw tooth to the pinion gear of the operation-time adjusting shaft may be varied to change the setting angle of the adjusting shaft so that the setting operation of the adjusting shaft can be easily effected. It is further allowable to change the distance of the graduated dial depending upon the shape of the hoist portion of the cam surface; the dial can be easily set. The opening and closing operations of the switch are performed when the engaging portions of the swinging member and the operation member are engaged together or disengaged. The opening and closing operations are therefore carried out quickly, whereby the switching operation is not affected by the dispersion in dynamic point of the switches, giving precisely controlled operation time and reliable opening and closing operations. When the operation time is set at the continuous current-carrying state, the swinging member is pulled apart from the cam member after the initially reset state has been completed; there is no sliding contact between the two members contributing to the enhanced durability. In this way, the present invention provides a periodical switching device which permits the operation time to be adjusted, exhibiting various excellent effects.

[Third Embodiment]

FIG. 22 to FIG. 36 show a third embodiment according to the present invention.

The switching devices shown in the first and second embodiments have the digital switch opening-closing mechanisms. With such mechanisms, if a switch opening-closing period of one cycle is set, for example, at 30 seconds, the switch closure time at 30% of one cycle, i.e., at 9 seconds, the switch opening time at 70% of one cycle, i.e, at 21 seconds, and if the switching device is operated for 1 minute and 10 seconds, the switching device stops at a position C which is 10 seconds after the third period has started as shown in FIG. 21. Then, if the switch closure time is set at 50% of one cycle, i.e., at 15 seconds, the switch opening time at 50% of one cycle, i.e., at 15 seconds, and if the switching device is set to operate for 2 minutes, the second operation starts from the position C at which the initial setting has completed, i.e., starts from 1 minute and 10 seconds which is one second after the 1 minute and 9 seconds at which the switch of the previous setting has opened. Therefore, the switch is kept opened for 20 seconds, i.e., 30 seconds minus 10 seconds, and thereafter the switch is closed for 15 seconds and opened for 15 seconds repetitively. The operation of the switch then comes into halt after 2 minutes have passed from the aforementioned position C. Therefore, a planned operation time of a total of 60 seconds consisting of 15-second openings and 15-second closings, virtually, becomes an operation time of 20 seconds+(3×15 seconds)=65 seconds of opening and 3×15 seconds+10 seconds=55 seconds of closure. Thus, the switch closure time and the switch opening time are virtually varied by the previously set operation time of the switching device and by the previously set operation-duration time. Let it be supposed that the switch closure time has been set at 10% of one cycle, i.e., at 3 seconds, the switch opening time at 90%, i.e., 27 seconds, and the switch has been set to operate for 1 minute and 10 seconds. In this case, if the switch closure time of the next time is set at 100%, i.e., continuous current-carrying state and the operation time set to work for 2 minutes, the virtual switch closure time of said next time will be 1 minute and 40 seconds. This tendency appears conspicuously when the previously set closure time is short and the switch closure time set for the next operation is long.

In view of the aforementioned points, therefore, the third embodiment of the present invention deals with a periodical switching device which is capable of adjusting the operation time, by permitting the newly set state to be immediately put into effect when the operation-time adjusting member is set at a new operation time, and further permitting the switching state to be converted to the continuous current-carrying state when the operation time is set at a current-carrying state close to the continuous current-carrying state.

That is, the switching device 101 consists of a mounting member made up of two pieces of mounting members 111 and 112, in which are incorporated a cam member 102, an electric motor 103 which serves as a driving source, an operation-time adjusting member 104, a swinging member 105, an operation member 106, a switch member 107, and a switch-operating member 108 as shown in FIG. 22 to FIG. 26. In said mounting member 112 are provided a plurality pieces of erected portions 113 folded from said mounting member 112, such that the two mounting members 111 and 112 are held together maintaining a predetermined distance. The erected portions 113 folded from the mounting member 112 may be replaced by support poles to maintain the distance between the two mounting members. To said mounting member are attached a cam shaft 114 and a fixed shaft 115. On said cam shaft 114 is formed a small-diametered portion 114*a* to which will be loosely fitted the cam member 102. The cam member 102 is integrally formed with a gear 121 to which will be transmitted the rotation of the electric motor 103 via a pinion gear 132 attached to an output shaft. The gear 121 may be provided separately from the cam member 102 and turned together therewith. At the center of the cam member 102 is formed a through hole 102*b* in which will be loosely inserted said cam shaft 114. On the upper side of the cam member 102 is formed a jaw portion 102*f*, and on the upper surface of the jaw portion 102*f*, i.e., on the upper end of the cam member 102 are provided a pair of cam surfaces 102*c*, and on the lower surface of the jaw portion 102*f* are formed a pair of saw-tooth projections 102*d*. As shown in FIG. 22, the shape of the cam surfaces 102*c* consist of a minimum-diametered portion A, a hoist portion B of which radius gradually increases with respect to the radius of gyration, and an outer circumferential portion D and portion E which falls from the outer circumferential portion toward the center. The radius of the hoist portion B may increase in proportion to the angle of gyration or may increase by unequal distances. To said fixed shaft 115 are loosely fitted a fan-shaped rack plate 141 of the operation-time adjusting member 104, the swinging member 105, the operation member 106 and a leaf spring 116.

As shown in FIG. 26 and FIG. 27, the operation-time adjusting member 104 is composed of said fan-shaped rack plate 141 and the operation-time adjusting shaft 143 to which is fastened the pinion gear 142. In said rack plate 141 are formed a through hole 141*a* in which will be loosely fitted said fixed shaft 115, folded portions 141*b*, 141*c*, and 141*d* formed on the right, left and rear sides of the through hole 141*a*, and a saw tooth 141*e* formed on a fan-shaped free end to come in mesh with the pinion gear 142. The rear folded portion 141*d* is downwardly extended and is folded at its lower portion in which a through hole 141*g* is formed so as to loosely insert the fixed shaft 115. In the right and left folded portions 141*b*, 141*c* are formed shaft-receiving holes 141*h* of square shape formed in a stepped manner. The shaft-receiving holes may of course be formed in a circular shape.

The swinging member 105 disposed beneath said rack plate 141 is formed in a generally rectangular shape, having a boss 151*a* which is upwardly protruded at one end and a through hole 151*c* formed at the center of said boss. On the lower side at the other end of the swinging member 105 are formed an engaging portion 152 shaping a stepped appearance and a downwardly protruded slide portion 153 located at the other side to slide on the cam surfaces 102*c*. On the outer periphery of the boss 151*a* is wound a spring 155. One end 155*a* of the spring 155 is hooked to a through hole 105*a* formed at a middle portion of the swinging member 105, and the other end 155*b* of the spring 155 is stopped by the folded portion 141*b* of the rack plate 141, such that the swinging member 105 is urged toward the clockwise direction in FIG. 22. Being urged by said spring 155, the slide portion 153 of the swinging member 105 is pressed onto the cam surfaces 102*c*. Said other end 155*b* of the spring 155 may also be hooked to a hole formed in the rack plate 141. The operation member 106 is located below the swinging member 105.

The operation member 106 has at its one end a through hole 106*a* in which the fixed shaft 115 is loosely inserted. Protrusions 106*b*, 106*c* are formed on both sides of the through hole 106*a*. The protrusions 106*b*, 106*c* are fitted to the shaft-receiving portions 141*h* formed in the folded portions 141*b*, 141*c*, of the rack plate 141 whereby the operation chamber 106 is so pivoted that its free end can be moved in the upper and lower directions. The free end of the operation member 106 is downwardly folded to form a step and has a tongue-shaped engaging portion 162 having sides 162*b*, and 162*a* extending in the right and left directions. Said engaging portion 163 is so formed as to ride on the engaging portion 152 of the swinging member 105. Below said operation member 106 is disposed a leaf spring 116 having two relatively large through holes 116*a*, 116*b* in which is inserted the fixed shaft 115. The leaf spring 116 is curved in a U-shape and interposed between the operation member 106 and the folded portion 141*d* of the rack plate 141 to press the operation member 106 and the swinging member 105 onto the rack plate 141.

The operation-time adjusting shaft 143 is rotatably fitted to the through holes formed in the mounting members 111 and 112, for example hole 112*a* in member 112. The pinion gear 142 is secured to the upper side of the operation-time adjusting shaft 143, a pin 144 is attached above the pinion gear 142, and a pin 146 is attached at a middle portion of the operation-time adjusting shaft 143. When the operation-time adjusting shaft 143 is mounted on the mounting member, a click-stop leaf spring 145 is inserted between the pin 144 and the mounting member 112. The click-stop leaf spring 145 is formed with three legs, the tip of one leg 145*a* thereof being folded downwardly and having a groove 145*b* in which will be inserted said pin 144. The other two legs 145*c* and 145*d* are slightly curved upwards to downwardly press the operation-time adjusting shaft 143. An upwardly directed projection 145*e* is formed on both or either one of said two legs 145*c* and 145*d*, and a plurality of through holes 112*b* and an engaging portion 112*e* are formed in the mounting member 112. When the projection 145*e* is inserted in the through hole 112*b*, the click-stop leaf spring 145 exhibits its click-stop function. The engaging portion 112*f* is protruded toward the click-stop leaf spring 145, and exhibits the same function as that of the engaging portion 112*e* for feeding shown in FIG. 36, which will be mentioned later, Here, the through hole 112*b* and the engaging portion 112*e* may be half-punched to form a hole and a protrusion, respectively. The mounting member 112 has a folded portion 112*c* formed by folding the edge and a folded portion 112*d* formed by cutting and erecting a portion of the mounting member 112 at distances nearly equal from said through hole 112*a*. The two folded portions 112*c* and 112*d* are so disposed as to come into contact with the pin 144 and stop the pin when the operation-time adjusting shaft 143 is turned. The switch member 107 consists of a microswitch attached to an erected portion 113 of the mounting member 112 by a screw. The switch member may be constituted using other switches. Normally-closed switch is used in this embodiment.

A switch-operating member 108 is provided between said cam member 102 and the switch member 107. The switch-operating member 108 is rotatably supported by a shaft 185 which is cantilevered to the erected portion 113 of the mounting member 112 and is secured from being removed by a circular clip 185*a*. The shape of the switch-operating member 108 consists of a pair of shaft-receiving portions 181 pivoted by said shaft 185, a first tongue portion 182 extending toward the tongue-shaped engaging portion 162 of the operation member 106, a hook portion 183 extending from one side of the shaft-receiving portion 181 to engage with the saw-tooth projection 102*d* of the cam member 102, and a second tongue portion 184 extending in a direction opposite to said first tongue portion 182 and folded upwardly. On one side of the first tongue portion 182 are formed a downwardly protruded mountain-shaped engaging portion 182*a* and an upwardly folded engaging portion 182*b*. The mountain-shaped engaging portion 182*a* rides on the left upper surface of the tongue-shaped engaging portion 162 of the operation member 106, and is pushed upwardly together with the operation member 106 by said leaf spring 116. The second tongue portion 184 is opposed to a contactor 107*a* of the switch member 107.

The folded engaging portion 182*b* is so disposed as to be pushed down when it has engaged with the pin 146 attached to the middle portion of the operation-time adjusting shaft 143 of the operation-time adjusting member 104. Said pin 146 serves as a clear-operation portion of old setting-clearing means for clearing old setting, and said folded engaging portion 182*b* serves as clear follower. When the rotating angle of the operation-time adjusting shaft 143 of the operation-time adjusting member 104 is set at nearly 180 degrees by means of said folded portions 112*c* and 112*d*, the folded engaging portion 182*b* defines an angle of about 25 degrees before the pin 146 rides thereon from the side of the folded portion 112*d*. The folded engaging portion 182 may of course define an angle greater than 25 degrees or smaller than 25 degrees.

The switching device 101 constructed as mentioned above permits the circuit of the switch member 107 to be connected in series between an a-c power supply and a device 109 such as an electronic range which is to be controlled as shown in FIG. 28, such that the electric motor 103 is connected in series with the power supply. To the above electric circuit may be connected a main switch, a timer switch 110 for setting the operating time, and the like. If the timer switch 110 is turned on, the electric motor 103 starts to rotate causing the cam member 102 to turn clockwise in the drawing. Then, if the operation-time adjusting shaft 143 is turned clockwise until the pin 144 comes into contact with the folded portion 112*d* of the mounting member 112 as shown in FIG. 22, the switch member 107 establishes the longest period of switch closure time, i.e., continuous current-carrying state. Under this state, the fan-shaped rack plate 141 of the operation-time adjusing member 104 is fully turned counterclockwise with the fixed shaft 115 as a center, whereby the tongue-shaped engaging portion 162 of the operation member 106 turned together with the rack plate 141 enters beneath the engaging portion 152 of the swinging member 105. The mountain-shaped engaging portion 182*a* of the first tongue portion 182 of the switch-operating member 108 is turned clockwise with the shaft 185 as a center and rides on the tip of the left side 162*a* of the tongue-shaped engaging portion 162 being pressed by the force of the contactor 107*a* of the switch member 107. The normally-closed switch remains closed. The swinging member 105 is clear of the cam surfaces 102*c* of the cam member 102. The right side 162*b* of the tongue-shaped engaging portion 162 remains located beneath the engaging portion 152 of the swinging member 105, whereby the switch is not allowed to be opened.

When the switch closure time is set at the continuous current-carrying state and at a position close to the continuous current-carrying state, the pin 146 which constitutes the aforesaid clear-operation portion rides on the folded engaging portion 182*b* of the first tongue portion 182 of the switch-operating member 108 constituting the clear follower, whereby the first tongue portion 182 and the tongue-shaped engaging portion 162 of the operation member 106 are pushed downwardly so that the tongue-shaped engaging portion 162 is pulled apart from the engaging portion 152 of the swinging member 105. The pin 146 rides on the folded engaging portion 182*b*, so that the switch-operating member 108 is turned clockwise with the shaft 185 as a center as shown in FIG. 24; the switch is maintained in the closed state.

Then, if the operation-time adjusting shaft 143 is turned counterclockwise until the pin 144 comes into contact with the folded portion 112*c* of the mounting member 112 as shown in FIG. 29, the switch member 107 acquires a position at which the period of switch closure time is the shortest. Referring to FIG. 29, the slide portion 153 of the swinging member 105 is pressed by the spring 155 onto the minimum-diametered portion A of the cam surfaces 102*c*, the operation member 106 and the switch-operating member 108 are pushed upwards by the leaf spring 116, and the right side 162*b* of the tongue-shaped engaging portion 162 of the operation member 106 is pushed to the lower surface of the left side 152*a* of the engaging portion 152 of the swinging member 105 as shown in FIG. 29 and FIG. 30. The second tongue portion 184 of the switch-operating member 108 is pushed by the contactor 107*a* of the switch member 107, causing the waveformed engaging portion 182*a* to be pushed onto the tongue-shaped engaging portion 162. The switch is closed, and the hook portion 183 of the switch-operating member 108 is located beneath the jaw portion 102*f* of the cam member 102.

If the cam member 102 is turned clockwise from the aforesaid state established by the cam member 102, swinging member 105, operation member 106, and the switch-operating member 108, the slide portion 153 of the swinging member 105 is pushed outwardly by the hoist portion B of the cam surfaces 102*c*, whereby the engagement between the engaging portion 152 and the tongue-shaped engaging portion 162 of the operation member 106 is disengaged as shown in FIG 25. The tongue-shaped engaging portion 162 of the operation member 106 is moved upwards, the switch-operating member 108 is turned counterclockwise with the shaft 185 as a center, and the switch is opened.

As the cam member 102 further turns, the slide portion 153 passes over the outer circumferential portion D of the cam surface 102*c* and falls on the minimum-diametered portion A along the falling surface E. Then the saw-tooth projection 102*d* of the cam member 102 comes to the hook portion 183 of the switch-operating member 108. As the cam member 102 further rotates, the hook portion 183 is pushed down by the saw-tooth projection 102*d* as shown in FIG. 30, whereby the tongue-shaped engaging portion 162 is pushed down by the mountain-shaped engaging portion 182*a*, and the engaging portion 152 rides on the upper surface of the tongue-shaped engaging portion 162 to return to the state shown in FIGS. 29 and 30, so that the switch is closed. While the cam member 102 turns one cycle, the switch repeats the closure of a short period of time and the opening of a long period of time.

When the rotating angle of the operation-time adjusting shaft 143 is selected within an operation-time adjusting range from the shortest period of time at which the pin 144 of FIG. 29 comes into contact with the folded portion 112*c* through up to the continuous current-carrying state at which the pin 144 of FIG. 22 comes into contact with the folded portion 112*d*, the position of the tongue-shaped engaging portion 162 of the operation member 106 varies depending upon said rotating angle of the operation-time adjusting shaft 143, the swinging member 105 is caused to swing by the cam surfaces 102*c* of the cam member 102, the switch is closed while the engaging portion 152 and the tongue-shaped engaging portion 162 of the operation member 106 are engaged together, and the switch is opened while said two engaging members are not engaged, thereby to open and close the switch according to the operation time set by the operation-time adjusting member 104 within one cycle.

Below are illustrated the clear-operation portion for clearing the old setting and the old setting clearing means actuated by said clear operation portion when said operation-time adjusting member is set at a new operation time. With the switching devices without having the clear-operation portion and the clear follower, the previously set state of the operation time greatly affects the subsequently set operation time, as mentioned earlier. If a clear follower provided on the switch-operating member 108 and on the operation member 106 mentioned in the first embodiment, is pushed down, there develops the below-mentioned phenomenon.

First, the switch closure time is set at a short period of time as shown in FIG. 29. If the cam member 102 is turned under this state, the switch is closed for a short period of time and opened for a long period of time within one cycle, and this opening-closing operation is stopped after a separately set operation time has passed. Then, if an operation time is newly set, the switch develops the phenomenon that was illustrated earlier. However, when the old set state is terminated while the switch is opened, the tongue-shaped engaging portion 162 of the operation member 106 and the swinging member 105 establish the following relation in position; i.e., the slide portion 153 of the swinging member 105 comes into slide contact with the cam surface 102*c* and is stopped at a position away from the right side 162*b* of the tongue-shaped engaging portion 162. Then if the switch closure time is newly set to be longer than the previously set time, the right side 162*b* of the tongue-shaped engaging portion 162 is turned counterclockwise in FIG. 32 and approaches the end surface of the engaging portion 152 of the swinging member 105, such that the tongue-shaped engaging portion 162 causes the swinging member 105 to further turn counterclockwise in FIG. 33 against the force of the spring 155 depending upon the duration of the newly set time. Due to this rotation, the slide portion 153 is separated from the hoist portion B or the minimum-diametered portion A of the cam surface 102*c*. To push down the clear follower after the new operation time has been set, means that the slide portion 153 which is separated away from the cam surfaces 102*c* is pushed down. Accordingly, the right side 162*b* of the tongue-shaped engaging portion 162 is disengaged from the end surface of the engaging portion 152 of the swinging member 105 and is caused to fall downwardly. As the tongue-shaped engaging portion 162 falls, the swinging member 105 is returned to a position at which the slide portion 153 comes into contact with the cam surface 102*c* being pushed by the spring 155, so that the tongue-shaped engaging portion 162 rides on the engaging portion 152 of the swinging member 105. The quantity of engagement between the engaging portion 152 and the tongue-shaped engaging portion 162 is determined by the quantity of setting the operation time and the position at which the slide portion 153 comes into slide contact with the cam surface 102*c*. Under this state, the switch is closed. The first time x from the moment the switch is closed by pushing down the clear-operation portion until the switch is opened, is equal to the newly set operation time y minus the time z in which the switching device previously set has operated from the beginning of the one cycle to the stopped position C, as shown in FIG. 35-(*a*). After the next cycle, the switch performs the opening-closing operation with the newly set operation time y.

If the clear follower consisting of the folded engaging portion 182*b* is provided at the continuous current-carrying state of at a position close to the continuous current-carrying state which is located at a position of about 25 degrees in angle from the folded portion 112*d* as mentioned earlier, and if the engagement is disengaged being pushed down by the clear-operation portion composed of pin 146, the switch remains closed from the position C at which the previously set switching device has stopped to a position close to the beginning of the next cycle or to the beginning of the next cycle at which the continuous current-carrying state is established, as shown in FIG. 35-(*b*). Thereafter, the opening-closing operation is repeated depending upon the setting. The newly set switching device 1 is started from the position C at which it stopped in the previous setting.

The aforesaid operation portion may be constituted by any other push-down members than the pin 146 fastened to the operation-time adjusting shaft 143. The operation portion may also be so designed as to be pushed down at positions other than the continuous current-carrying state or at a position close to the continuous current-carrying state.

Since the operation portion illustrated in the foregoing was made of a long pin 146, the pin 146 is allowed to move over a long distance maintaining a contact with the folded engaging portion 182*b* that serves as a clear follower. Utilizing the abovesaid contacting effect, it is possible to push down the clear follower keeping a contacting relation over a range of 10 degrees from the swinging member 105 within the range of 180 degrees in which the operation-time adjusting shaft 143 is allowed to turn.

FIG. 36 shows an operation means for feeding (or advancing) the operation-time adjusting member from a position close to the continuous current-carrying state to the continuous current-carrying state, in which a downwardly faced mountain-shaped engaging portion 112*e* is formed on the lower surface of the mounting member 112, the device being inverted for clarity in explanation, and said engaging portion 112*e* being upwardly directed in FIG. 36. The projection 145*e* of the click-stop leaf spring 145 mounted on the operation-time adjusting shaft 143 is used as other engaging portion for feeding the operation. The engaging portion 112*e* is so disposed that the center of the projection 145*e* of the click-stop leaf spring 145 rides on the top of the mountain of said engaging portion 112*e* when the pin 144 fastened to the operation-time adjusting shaft 143 is located at a position about 15 degrees before the folded portion 112*d*, e.g., before the pin 144 comes into contact with the folded portion 112*d* to establish the continuous current-carrying state.

The mountain-shaped engaging portion 112*e* for feeding operation may be replaced by an oval hole consisting of a hole having large diameter in which will engage the projection 145*e* at the position of continuous current-carrying state and a small hole located at a position moved back by about 15 degrees in the counterclockwise direction from the position of continuous current-carrying state.

With the feed operation means being composed of said engaging portion for feeding operation, the operation time can be automatically set at the 100%, i.e., at the continuous current-carrying state when the switch closure time of the switch is occupying more than about 83% of one cycle, by turning the operation-time adjusting shaft 143. The aforesaid angle may be set at angles other than 15 degrees depending upon the requirements. In controlling the radiation of magnetron by means of the aforesaid switching device, the life of the magnetron will be adversely affected if, for example, the magnetron is kept energized with the current-carrying period being set at 90% and the current-interrupting period being set at 10%. Using the abovementioned feeding mechanism, however, the cases in which the current-carrying period is 83% to 100% and the current-interrupting period is 0 to 17%, can be automatically set to the current-carrying period of 100% eliminating the current-interrupting period, contributing to greatly extend the life of the magnetron.

What is claimed is:

1. A periodical switching device capable of adjusting operation time, comprising;

a switching means for opening and closing an electric circuit;

a cam member which periodically operates being interlocked to a source of driving;

a swinging member for contacting a cam surface of said cam member;

an operation member which rides on and engages said swinging member and disengages from said swinging member according to swinging motion of said swinging member thereby to operate said switching means;

an operation-time adjusting means which adjusts the swinging member relative to said cam surface; and a mounting member which holds relative positions of said swinging member and said operation-time adjusting means, said swinging member and said operation member, and said operation member and said switching means;

wherein the operation time of said switching means is set by the adjusting means adjusting the position of said swinging member relative to said cam member.

2. A periodical switching device capable of adjusting the operation time according to claim 1, wherein said cam member is pivoted to a cam shaft mounted on said mounting member, and said cam member is equipped with the cam surface for pushing out a slide portion of the swinging member that is urged by a spring, as well as a saw-tooth projection for actuating the operation member.

3. A periodical switching device capable of adjusting the operation time according to claim 1, wherein said cam surface consists of a hoist portion of which radius gradually increases with an angle of gyration, and a surface which falls from a circumference of said cam member toward a center thereof.

4. A periodical switching device capable of adjusting the operation time according to claim 1, wherein;

the swinging member and the operation-time adjusting means are pivoted to a fixed shaft mounted on the mounting member; and said swinging member is equipped with a slide portion, and a projection on which will ride an engaging portion of the operation member.

5. A periodical switching device capable of adjusting the operation time according to claim 1, wherein;

the operation-time adjusting means is composed of a rack plate in which are formed a saw tooth and an operation-time adjusting shaft to which is secured a pinion that comes in mesh with said saw tooth; and said rack plate is equipped with shaft-receiving holes which rotatably pivots the operation member, a hook portion to which is hooked a spring that urges the swinging member onto the cam surface.

6. A periodical switching device capable of adjusting the operation time according to claim 1, wherein;

the operation member is rotatably pivoted at its one end by the operation-time adjusting means, and possesses at the other end a folded portion which engages with a saw-tooth projection of the member an engaging portion which rides on the projection having notched step formed in the swinging member, and a folded tongue portion for actuating the switching means.

7. A periodical switching device capable of adjusting the operation time according to claim 1, wherein;

the mounting member is composed of a mounting member and another mounting member having erected portions; and on said mounting members are mounted a cam shaft, a fixed shaft and the switching means, and is further pivoted an operation-time adjusting shaft, such that each of these components are supported at their relative positions.

8. A periodical switching device capable of adjusting the operation time according to claim 1, wherein;

an end of the operation member is rotatably pivoted to the operation-time adjusting means;

on the other end of said operation member is provided an engaging portion which engages with a projection having notched step formed in the swinging member; and the movement of said operation member is transmitted to the switching means via a switch-operating member.

9. A periodical switching device capable of adjusting the operation time according to claim 1, wherein;

a switch-operating member is rotatably mounted on the mounting member; and said switch-operating member is equipped with a first tongue portion which will ride on the operation member, a second tongue portion which engages with a saw-tooth projection of the cam member and a third tongue portion which comes into contact with the switching means.

10. A periodical switching device capable of adjusting the operation time according to claim 1, wherein there is provided an old setting-clearing means for clearing the old setting when the operation-time adjusting means is set at a new operation time.

11. A periodical switching device capable of adjusting the operation time according to claim 1, wherein there is provided an old setting-clearing means for clearing the old setting when the operation-time adjusting means is set at a current-carrying state near to the continuous current-carrying state.

12. A periodical switching device capable of adjusting the operation time according to claim 10, wherein the old setting-clearing means is constituted by providing a clear-operation portion on the operation-time adjusting means and by providing a clear follower on the operation member.

13. A periodical switching device capable of adjusting the operation time according to claim 10, wherein the old setting-clearing means is constituted by providing a clear follower on a switch-operating member which transmits the operation of the cam member to the operation member and which also operates the switching means, and providing a clear-operation portion on the operation-time adjusting means.

14. A periodical switching device capable of adjusting the operation time according to claim 11, wherein there is provided a feeding operation means for feeding the operation-time adjusting means to the continuous current-carrying state when said operation-time adjusting means is set at a position close to the continuous current-carrying state.

15. A periodical switching device capable of adjusting the operation time according to claim 14, wherein the operation-time adjusting means is equipped with a click-stop leaf spring, and an engaging surface of said leaf spring mounted on the mounting member is formed with an engaging portion for feeding operation.

* * * * *